United States Patent [19]

Zeigler

[11] 4,044,750

[45] Aug. 30, 1977

[54] BARBEQUE BLOWER

[76] Inventor: Kenneth H. Zeigler, 23851 Larkwood St., El Toro, Calif. 92630

[21] Appl. No.: 670,984

[22] Filed: Mar. 26, 1976

[51] Int. Cl.[2] ..... F01D 17/00; F04D 29/56

[52] U.S. Cl. ..... 126/25 B; 415/159; 417/360; 417/411

[58] Field of Search ..... 417/313, 411, 423 R, 417/360; 126/25 B; 415/159; 248/226 B, 226 C, 228

[56] References Cited

U.S. PATENT DOCUMENTS

| | | | |
|---|---|---|---|
| 879,580 | 2/1908 | Pearsall | 417/328 |
| 2,464,672 | 3/1949 | Clapp | 248/228 |
| 3,096,933 | 7/1963 | Bora | 417/423 R |
| 3,396,904 | 8/1968 | Janette | 415/159 X |
| 3,529,556 | 9/1970 | Barnes | 126/25 B |
| 3,697,198 | 10/1972 | Holder, Jr. | 126/25 B X |

FOREIGN PATENT DOCUMENTS

| | | | |
|---|---|---|---|
| 450,462 | 10/1927 | Germany | 417/423 |

*Primary Examiner*—Carlton R. Croyle
*Assistant Examiner*—Leonard Smith
*Attorney, Agent, or Firm*—William C. Babcock

[57] ABSTRACT

A mechanically or electrically actuated barbeque blower that may be removably secured to the rolled upper edge of a barbeque fire box or other desired portion of the barbeque unit to generate a draft in a desired direction that is of material assistance in igniting all of the charcoal briquettes in the fire box, as well as maintaining the briquettes in a glowing heat-emitting condition.

3 Claims, 4 Drawing Figures

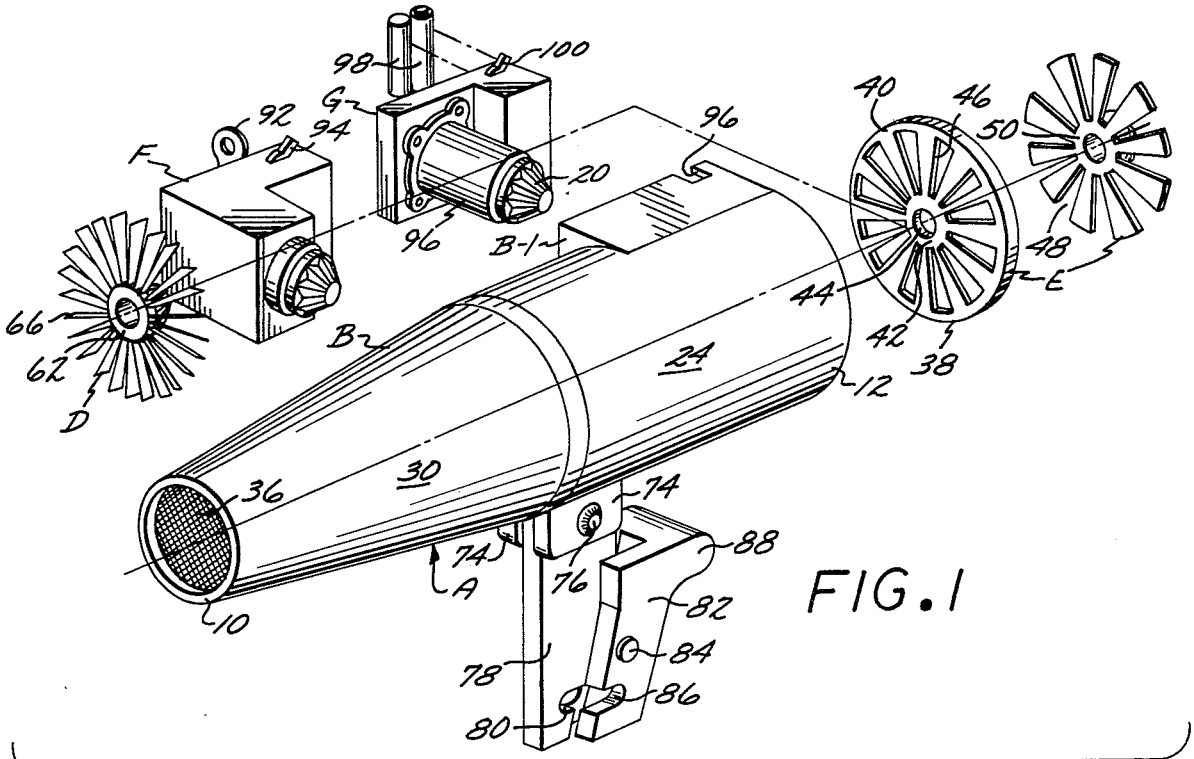
FIG. 1
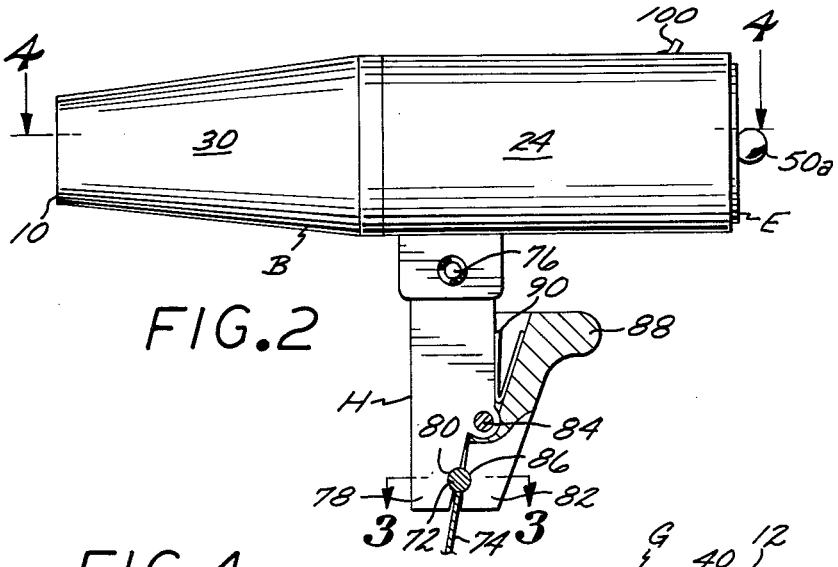
FIG. 2
FIG. 3
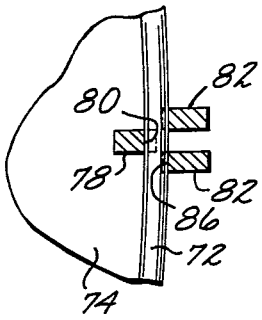
FIG. 4
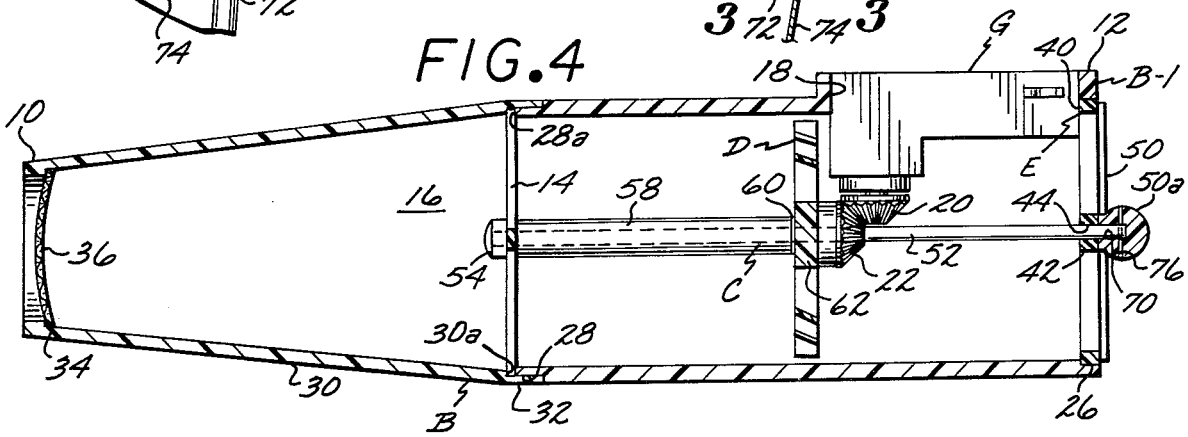

BARBEQUE BLOWER

BACKGROUND OF THE INVENTION

1. Field of the Invention

A barbeque blower.

2. Description of the Prior Art

In the use of barbeque units that employ charcoal briquettes as fuel or a source of heat, a troublesome problem is the igniting of all of the briquettes to provide a bed of coal, and to maintain the ignited briquettes in a hot blowing condition. Various make-shift devices have been employed in the past to attempt to accomplish the above objectives.

A major object of the present invention is to supply a compact device of simple mechanical structure, that may be removably mounted on the barbeque unit, preferably on the rolled edge of the fire box thereof, and the unit when so disposed capable of being actuated to transform air from the ambient atmosphere into a stream thereof that is directed across the briquettes to maintain them at a desired heat emitting condition.

Another object of the invention is to supply a barbeque blower that may be fabricated from standard commercially available materials, is simple and easy to use, and one that may be mounted on or removed from a barbeque unit with a minimum of inconvenience.

A still further object of the invention is to provide a barbeque blower that may be actuated by either mechanical or electrical means, and, due to the simplicity of the blower and the low cost thereof, will encourage the widespread use of the blower.

SUMMARY OF THE INVENTION

The barbeque blower is used in combination with a barbeque unit that has a fire box in which charcoal briquettes are disposed, with the fire box being of a type that preferably has a rolled upper edge. The blower unit, when removably secured to the fire box or other desired portion of the barbeque unit, may be oriented in a desired direction relative to the fire box to generate a stream of air that sweeps across the briquettes to serve as a draft to assist in the initial ignition of the briquettes and to maintain the briquettes in a glowing heat emitting condition.

The barbeque blower includes an elongate hollow first housing having first and second open end portions that are connected by a longitudinal internal passage. A transverse opening is formed in the housing adjacent the second end portions thereof, with the opening being surrounded by a second housing that extends outwardly from the first housing. A transverse spider is disposed within the longitudinal passage of the first housing. Power-operated means are removably mountable in the second housing, with the power-operated means including a first metal gear that is disposed in the longitudinal passage. Manually adjustable rotatable air intake means are mounted on the second end portion of the housing. An elongate shaft is disposed in the longitudinal passage and is coaxially aligned therewith. The shaft is supported on one end by the spider and has a portion of manually adjustable rotatable air intake means secured to the opposite end thereof. A multi-bladed transverse circular fan is rotatably supported on the shaft, with the fan including a second metal gear that is in toothed engagement with the first metal gear. A spring-loaded clamp is provided that removably engages the rolled edge of the barbeque fire box, or other desired portion of the barbeque unit, with the clamp pivotally supporting the first housing to permit it to be angularly adjustable relative to the charcoal briquettes residing in the fire box. When the power-operated means is actuated, the fan is driven on the elongate shaft, and tends to draw air from the second end portion of the housing and discharge the latter as a stream of air from the first portion of the housing. The stream of air so discharged serves as a draft to assist in the initial ignition of the charcoal briquettes, as well as to maintain the briquettes in a hot, glowing condition. The volume of air that is discharged as a stream by the fan is controlled by manual adjustable rotatable air-intake means on the second end portion of the housing. When the device is not required, it is easily and simply removed from the barbeque unit and stored in a convenient location until again required.

BRIEF DESCRIPTION OF THE DRAWING

FIG. 1 is an exploded perspective view of the barbeque blower;

FIG. 2 is a side elevational view of the device;

FIG. 3 is a fragmentary transverse cross sectional view of the blower taken on the line 3—3 of FIG. 2; and FIG. 4 is a longitudinal cross-sectional view of the blower taken on the line 4—4 of FIG. 2.

DESCRIPTION OF THE PREFERRED EMBODIMENT

The barbeque blower A, as may be seen in the drawings, includes an elongate housing B that has a first open end 10 and second open end portion 12, which end portions are connected by an internal longitudinal passage 16. The housing B intermediate the first and second end portions 10 and 12 has a transverse spider 14 therein. A longitudinal shaft assembly C is disposed in the passage 16, with one end of the shaft assembly being supported by the spider 14 and the opposite end being supported on a manually adjustable air intake E that is mounted on the second end portion 12 of the housing. The housing B, adjacent the second open end portion 12 thereof, has an opening 18 therein that at all times communicates with the longitudinal passage 16. A second housing B-1 is secured to the housing B and extends outwardly therefrom and surrounds the opening 18. The second housing B-1 is adapted to have either a spring-actuated motor F removably mounted therein or an electrically operated motor G, both of which motors are shown in FIG. 1. Irrespective of whether a spring-operated motor F or an electrically operated motor G is used in conjunction with the barbeque blower A, the motor drives a first bevel gear 20. A multi-bladed circular fan D is provided, as may be seen in FIGS. 1 and 4, that is rotatably supported on the shaft C. The fan F has a second bevel gear 22 secured thereto, with the first and second bevel gears at all times being in toothed engagement, as may be seen in FIG. 4. The first and second bevel gears 20 and 22 are in toothed engagement, when either the spring-loaded motor F or electrically operated motor G is inserted within the confines of the second housing B-1 as shown in FIG. 4. Adjustable air intake assembly E is mounted on the second end portion 12 of the housing B, and in addition to serving this function, also serves as a support of one end of the shaft assembly C.

The housing B is preferably moulded from a suitable polymerized resin and may be formed either as an integral unit, or from multiple parts as shown in FIG. 4.

When the housing B is formed from multiple parts, it will include a cylindrical shell 24 in which the opening 18 is formed and from which the second housing B-1 projects. The shell 10 has a second end portion in which a circumferentially extending recess 26 is formed. A first end of the shell 24 has a recess 28 defined therein as shown in FIG. 4. The housing B includes a forwardly disposed conical portion 30 that has a second end portion from which a tongue 32 extends that engages the recess 28. The conical portion 30 has a forwardly disposed first end portion of minimum cross-section in which an internal body shoulder 34 is defined that serves as an abuttment to hold a transverse screen 36 in place within the portion 30. The spider 14 is removably held in place within the confines of the housing B by having peripheral edge portions thereof engaged by circumferentially extending surfaces 28*a* and 32*a* defined on the shell 24 and portion 30. The adjustable air intake E, as best seen in FIG. 1, includes a first stationary member 38 that has a ring 40, a hub 42 in which a bore 44 is defined, and circumferentially spaced spokes extending between the hub and ring, which spokes define elongate triangular shaped apertures 46 therebetween. The ring 40 is permanently secured to the part of the shell 24 defining the recess 26 by conventional means, such as glue, adhesive, or the like. A circular member 48 is provided as shown in FIG. 1 that has a hub 50 from which a number of circumferentially extending blades 50 project, with these blades preferably being of triangular shape. The shaft assembly C, as may be seen in FIG. 4, includes an elongate shaft 52 that has a head 54 on the forward end thereof, and the shaft having the forward end portion rotatably mounted in a centrally disposed transverse opening 56 defined in the spider 14. The shaft 52 on the forward portions thereof, has a spacer tube 58 mounted thereon with the forward end of the spacer tube abutting against the spider 14 and the rearward end 60 of the spacer tube abutting against the forward face of a hub 62 that forms a part of the fan D, and from which hub a number of circumferentially spaced blades 64 project. The hub 62 has a transverse bore 66 extending therethrough that is best seen in FIG. 1. The bore 66 rotatably supports the fan D on the shaft 52 as illustrated in FIG. 4. The fan D has the second bevel gear 22 projecting rearwardly therefrom with the fan and second bevel gear being rotatable relative to the shaft 52 when the first bevel gear 20 is driven either by the spring operated motor F or electrically operated motor G. The second portion 48 of the adjustable air intake E includes the handle 50*a* secured to the hub 50 and extending rearwardly therefrom as viewed in FIG. 4. The hub 50 and handle 50*a* have a recess 70 extending therein in which the rearward end portion of shaft 52 is disposed and the shaft being secured to the handle by a pin 72 that extends transversely through alinged openings formed in the handle and rearward shaft portions. Of course, other conventional fastening means may be employed to secure the hub 50 and handle 58 to the shaft 52. When the air intake assembly E is mounted on the housing B, as illustrated in FIG. 4, the handle 50*a* permits rotation of the second portion 48 of the assembly, with the blades 50 moving circumferentially relative to the apertures 46 to restrict the effective area of the latter in allowing air to flow from the ambient atmosphere into the passage 16 as the multi-bladed fan D is driven by actuation of either the spring-operated motor F or electrically operated motor G. The housing B may be removably supported from the roller edge 72 on the portion of a wall that defines the fire box 74 of a barbeque unit as shown in FIG. 2 by an assembly H. Two laterally spaced and laterally alinged lugs 74 project downwardly from the shell 24 as may be seen in FIGS. 1 and 2, and have a pin or screw 76 extending therebetween. The screw 76 extends through an opening in the upper portion of a first clamp member 78, which clamp member has a first transverse recess 80 formed in the lower portion thereof. A second bifurcated clamp member 82 is pivotally supported from the first clamp member 78 by a pin or bolt 84, with the second clamp member having second recesses 86 defined therein that are aligned with the first recess 80. The second clamp member 82 has a trigger 88 extending outwardly therefrom, which trigger may be used to rotate the second clamp member in a counterclockwise direction as viewed in FIG. 2. A compressed spring 90 is disposed between the rearward portion of the first clamp member 78 and forward portion of the second clamp member 82 as shown in FIG. 2, and at all times tends to pivot the second clamp member in a clockwise direction whereby the first and second recesses 80 and 86 are forced into gripping contact with the rolled edge 72.

The spring-actuated motor F is of conventional design and has a spring thereof wound by use of a handle 92. The motor F includes an "on" and "off" lever 94 that is so disposed as to extend into a recess 96 in the second housing B-1 as shown in FIG. 1. By manipulating the lever 94, the rotation of the first bevel gear 20 associated with the spring-actuated motor F may be controlled to either stop or start rotation of the fan D. The electric motor 96 of the electrically operated device G is supplied with electric current through conduits 98. The electrically operated device G has a handle 100 of an "on" and "off" switch projecting upwardly therefrom, which handle is adapted to be inserted in recess 96 when the unit G occupies a position within the second housing B-1.

The use and operation of the invention is extremely simple. The invention, with either the spring-actuated motor F or electrically operated motor G inserted therein, is removably mounted on the rolled edge 72 of a fire box 74 by causing the assembly H to removably engage the rolled edge as previously explained. The screw 76 may be loosened to permit the housing B to be directed at a desired angle relative to the briquettes (not shown) in the firebox. The spring actuated motor F or electrically operated motor G, as the case may be, is actuated to cause rotation of the fan D, with air being drawn into the passage 16 through the adjustable air intake E, as previously described. By utilizing the handle 50*a,* the blade 50 may be rotated relative to the apertures 46 to restrict the effective area of the latter, and in so doing control the volume of air descharged as a stream from the forward ends of the housing B onto the briquettes (not shown).

The use and operation of the invention has been previously described in detail and need not be repeated.

I claim:

1. In combination with a barbeque fire box having a rolled upper edge, which fire box holds a plurality of charcoal briquettes in side-by-side relationship, a power-driven blower unit that may be oriented in a desired direction relative to said fire box to generate a stream of air that sweeps across said briquettes to serve as a draft to assist in the initial ignition of said briquettes and to maintain said briquettes in a glowing heat emitting condition after said ignition, said power-driven blower unit including:

a. an elongate housing that has first and second open ends;

b. a transverse spider in said housing intermediate said first and second ends;

c. an air intake member transversely disposed in said second end, said intake member having a number of circumferentially spaced air openings therein;

d. a transverse bladed fan disposed in said housing intermediate said spider and said second end;

e. a plate that defines a number of circumferentially spaced, radially extending spokes, said plate adjacently disposed to said air intake member, and said plate when rotated controlling the effective area of said openings in said air intake member;

f. a prime mover mounted on said housing adjacent said second end, said prime mover including a drive shaft that extends into said housing;

g. first and second meshing bevel gears, said first gear secured to said drive shaft and said second gear secured to said bladed fan;

h. a longitudinal shaft rotatably supported by said spider and said air intake member and rigidly secured to said plate, said shaft rotatably supporting said bladed fan;

i. a handle secured to said shaft adjacent said plate and outwardly disposed therefrom, said shaft serving the dual function of rotatably supporting said bladed fan, said rotatably adjusting said plate relative to said air intake member when said handle is manually rotated; and j. spring loaded clamp means secured to said housing that may removably engage said fire box to support said housing at a desired position on the latter, and the rate at which air is discharged from said first end of said housing being controlled by rotating said handle to vary the effective area of said air openings.

2. A power-driven blower unit as defined in claim 1 in which said spring loaded clamp means includes:

k. a pair of parallel laterally spaced apertured lugs that project from said first shell;

l. a first elongate clamp member that includes an end portion disposed between said lugs;

m. a rotatable manually adjustable member that extends through apertures in said pair of lugs and said first clamp member to hold said clamp member at a desired position relative to said lugs;

n. a second clamp member pivotally supported from said first clamp member, said first and second clamp members having first and second recessed end portions that engage said rolled edge when in pressure contact therewith; and o. spring means that at all times tend to pivot said second clamp member in a direction that said second recessed end portion is adjacently disposed to said first recessed end portion of said first clamp member.

3. A power driven blower unit as defined in claim 1 which in addition includes:

p. a trigger on said second clamp member for manually pivoting the latter in a direction whereby said second recessed end portion is separated from said first recessed end portion to permit said blower unit to be separated from said barbecue fire box.

* * * * *